US006237511B1

(12) United States Patent
Honkasalo

(10) Patent No.: US 6,237,511 B1
(45) Date of Patent: May 29, 2001

(54) METHOD AND DEVICE FOR BURNING DISINTEGRATED PLANT-BASED FUEL

(76) Inventor: Martti Honkasalo, Rentukantie 6, FIN-29250 Nakkila (FI)

( * ) Notice: Subject to any disclaimer, the term of this patent is extended or adjusted under 35 U.S.C. 154(b) by 0 days.

(21) Appl. No.: 09/180,952

(22) PCT Filed: May 21, 1997

(86) PCT No.: PCT/FI97/00305

§ 371 Date: Nov. 18, 1998

§ 102(e) Date: Nov. 18, 1998

(87) PCT Pub. No.: WO97/44619

PCT Pub. Date: Nov. 27, 1997

(30) Foreign Application Priority Data

May 22, 1996 (FI) ..... 962167

(51) Int. Cl.[7] ..... F23G 7/00; F23G 5/04; F23G 5/46; F23N 5/18

(52) U.S. Cl. ..... 110/342; 110/188; 110/224; 110/254; 110/302; 110/234; 110/346

(58) Field of Search ..... 110/348, 347, 110/346, 185, 186, 188, 218, 219, 224, 234, 254, 302, 304, 309, 342, 344, 227, 228

(56) References Cited

U.S. PATENT DOCUMENTS

| | | | | |
|---|---|---|---|---|
| 1,427,045 | * | 8/1922 | Wood | 110/227 X |
| 1,450,127 | * | 3/1923 | Witz | 110/227 |
| 1,468,137 | * | 9/1923 | Collins et al. | 110/227 |
| 1,578,181 | | 3/1926 | Palmer | 110/224 |
| 2,269,273 | * | 1/1942 | Krogh et al. | 110/228 X |
| 2,271,157 | * | 1/1942 | Badenhausen | 110/228 |
| 4,102,279 | * | 7/1978 | Groschl et al. | 110/234 |
| 4,235,174 | * | 11/1980 | Spurrell | 110/234 X |
| 4,309,965 | * | 1/1982 | Hill | 110/234 X |
| 4,409,909 | * | 10/1983 | Tomizawa et al. | 110/224 X |
| 4,411,204 | * | 10/1983 | Hamilton | 110/188 X |
| 4,474,010 | * | 10/1984 | Shibuya et al. | 110/347 X |
| 4,480,557 | * | 11/1984 | Hochmuth | 110/224 X |
| 4,516,511 | * | 5/1985 | Kuo | 110/227 X |
| 4,539,916 | * | 9/1985 | Paoluccio | 110/257 X |
| 4,592,293 | | 6/1986 | Toyama et al. | 110/347 |
| 4,732,090 | * | 3/1988 | Bollmann, Sr. et al. | 110/234 X |
| 5,184,600 | * | 2/1993 | Astle, Jr. | 110/185 X |

FOREIGN PATENT DOCUMENTS

| | | |
|---|---|---|
| 3913885 A1 | 10/1990 | (DE) . |
| 4431156 A1 | 3/1996 | (DE) . |
| 780822 | 5/1981 | (FI) . |
| 60435 | 9/1981 | (FI) . |
| 726745 | 3/1955 | (GB) . |
| 126749 C1 | 11/1949 | (SE) . |
| WO 94/11677 | 5/1994 | (WO) . |

OTHER PUBLICATIONS

*Patent Abstracts of Japan,* vol. 8, No. 230, M–333, of JP–A–59–112114, Jun. 28, 1984.
*Patent Abstracts of Japan,* vol. 7, No. 279, M–262, JP–A–58–156111, Sep. 17, 1983.

* cited by examiner

*Primary Examiner*—Ira S. Lazarus
*Assistant Examiner*—Ljiljana V. Ciric
(74) *Attorney, Agent, or Firm*—Smith, Gambrell & Russell

(57) ABSTRACT

A method of burning plant-based fuel is involved in which the plant-based fuel is burned in a boiler designed for burning dry fuel and with the plant-based fuel being used having a moisture value which can vary in range from dry to wet. The method involves heating air with heat energy from combustion gases of the boiler to provide a source of heated air and providing heat and flow amounts of the heated air, with derived heat energy from the combustion gases, to the fuel in an amount sufficient for drying the fuel in any condition presented amongst the range between dry and wet. The flow of the heated air directed to the fuel is controlled to provide sufficient drying of the fuel before use of the fuel in the boiler and such that the heated air not needed for drying the fuel is conducted into the boiler to serve as heated combustion air.

23 Claims, 1 Drawing Sheet

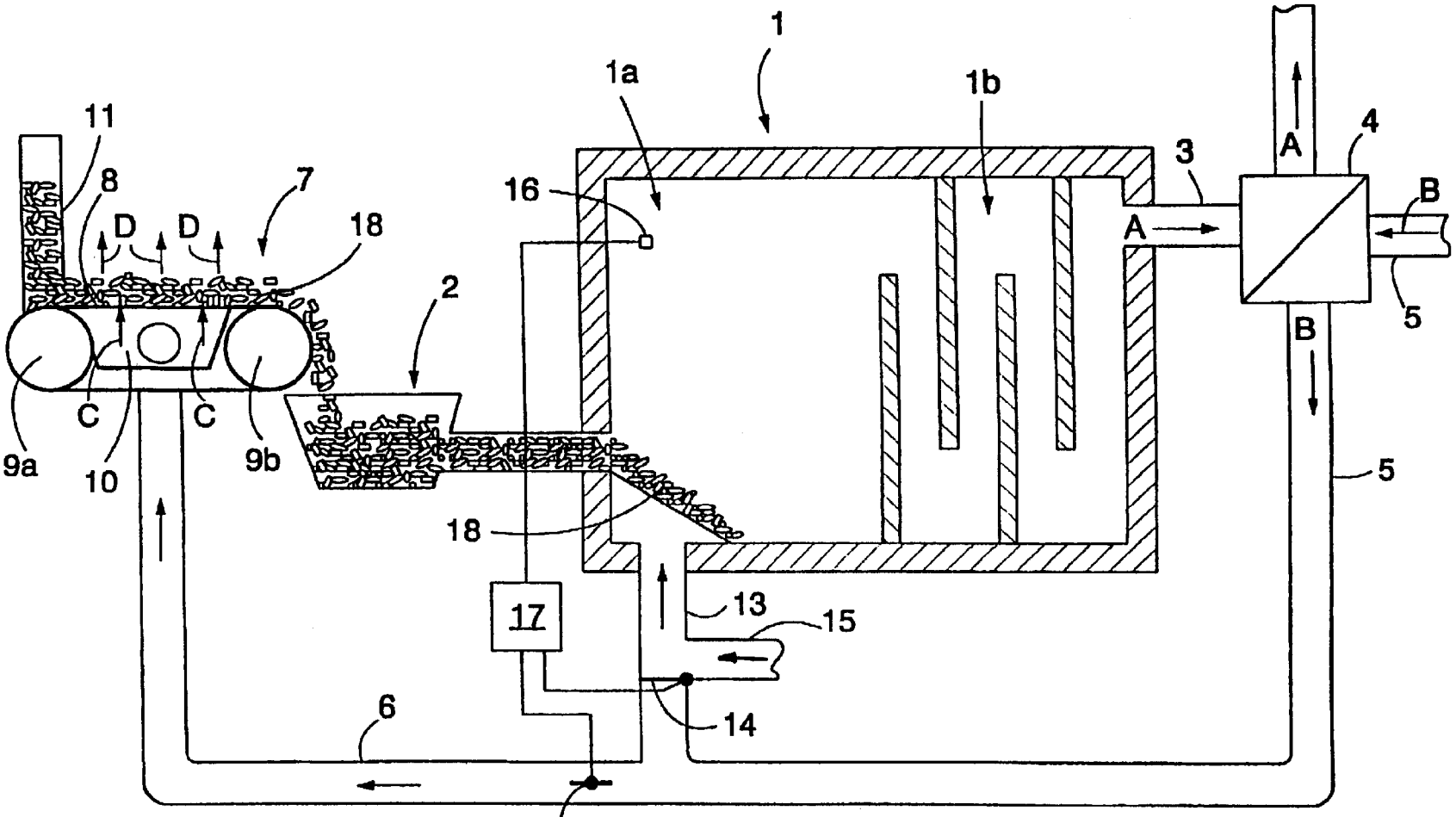
FIG.

METHOD AND DEVICE FOR BURNING DISINTEGRATED PLANT-BASED FUEL

FIELD OF THE INVENTION

The invention relates to a method of burning disintegrated plant-based fuel, in which method fuel is burned in a boiler designed for burning dry fuel, fuel is dried with the heat energy obtained from the combustion gases of the boiler and fed after that into a combustion chamber of the boiler for burning.

The invention relates further to an arrangement for burning disintegrated plant-based fuel, the arrangement comprising a boiler designed for burning dry fuel, a feeding apparatus for feeding fuel into a combustion chamber of the boiler, a drying apparatus for drying the fuel to be fed to the arrangement and means for feeding the heat energy of combustion gases of the boiler into the drying apparatus.

BACKGROUND OF THE INVENTION

In fairly small chip burning plants of a size class typically below 2 MW, the use of boilers planned for burning dry chips is most preferable, as far as purchase price is concerned. Such plants are poorly adapted to variations in the moisture of the fuel, i.e. they are not capable of burning for instance, unseasoned chips, bark or sawdust. When boilers are planned in such a way that also unseasoned fuel can be burned in them, the price of the plant easily rises higher. Primary price increasing factors are additional masonry for the combustion chamber, an enlarged convection part and preheaters of combustion air. A plant planned for burning moist fuel is also poorly suited for dry fuel, because dry fuel raises the temperature of the combustion chamber high and the plant will be subjected to resistance problems, for instance. If necessary, dry fuel must even be wetted. A plant planned for burning moist fuel is also poorly suited for small power level requirements because of difficult power control, particularly when dry fuel is used.

Finnish publication 780 822 discloses a fuel drying apparatus of a boiler. The drying apparatus comprises a fuel tank, from which the fuel is transported to a combustion chamber of the boiler. Combustion gases from the boiler are led into a closed space below the fuel tank, whereby the combustion gases heat the fuel. By this arrangement, moist fuel can be dried before it is led into the boiler, but when already dry fuel is fed into the fuel tank, the combustion gases dry it further completely unnecessarily, which causes a fire risk in the fuel tank, for instance.

Finnish publication 60 435 also discloses a fuel drying apparatus. The drying apparatus comprises a vertically longitudinal flat chamber heated by combustion gases, in which chamber there are horizontal screw conveyors on each other and under the screw conveyors chutes, in which the fuel passes from one screw conveyor to another back and forth and downwards. The combustion gases are directed to flow upwards in the chamber, whereby they dry fuel. The arrangement is inconvenient and complicated and the drying procedure cannot be controlled in any way, which means that when, for instance, dry fuel is fed it is dried unnecessarily and there is an obvious fire risk in the drying apparatus.

German Offenlegungsschrift 39 13 885 discloses a boiler arrangement for burning moist fuel. This arrangement comprises a slanting grate, to the upper end of which the fuel is led. The fuel is dried on the upper part of the grate by conducting combustion gases for the purpose of drying. The fuel dries on the drying part of the grate and it is burnt on the remaining part of the grate. This arrangement has a big and expensive structure and it is not suitable for burning dry fuel.

SUMMARY OF THE INVENTION

The object of this invention is to provide a method and an arrangement not characterized by the above-mentioned drawbacks and making it possible to burn disintegrated plant-based fuel of variable moisture.

The method according to the invention is characterized in that fuel the moisture of which can vary between dry and wet is used and that the combustion gases are conducted to heat air and that heat and flow amounts of this air are dimensioned in such a way that the air in question is sufficient for drying the fuel in all moisture conditions of the fuel and that the heated air is directed in such a way that the air not needed for drying fuel is conducted into the boiler to serve as combustion air.

Further, the arrangement according to the invention is characterized in that the arrangement comprises a heat exchanger and an air duct, the heat exchanger being arranged to heat the air flowing in the air duct with the heat energy of the combustion gases of the boiler, that the heat exchanger and the air flow amount are dimensioned in such a way that the air flowing in the air duct is sufficient for drying the fuel in all moisture conditions of the fuel and that the arrangement comprises means for conducting the air flowing in the air duct and not needed for drying the fuel into the boiler to serve as combustion air.

An essential idea of the invention is that the boiler of the arrangement is designed to burn dry fuel and that when moist or wet fuel is fed to the arrangement, the heat energy obtained from the combustion gases of the boiler is utilized for drying the fuel and the heat energy not needed for drying the fuel is directed to heat the combustion air of the boiler. Further, the idea of an embodiment consists in that the combustion gases are conducted to a heat exchanger heating the air which is led either to dry fuel or to serve as combustion air of the boiler, as needed. The idea of another preferred embodiment is that the fuel is dried by a wire dryer, the air heated with the heat energy of the combustion gases being conducted through the wire. The idea of a third preferred embodiment is that a recovery of the heat of drying air and the air flow to be led through the chips are dimensioned in such a way that the air flowing out through the chips is substantially saturated with water vapor. The idea of a further fourth preferred embodiment is that an air distribution either for a purpose of drying fuel or for serving as combustion air of the boiler is controlled on the basis of the temperature in the boiler.

An advantage of the invention is that fuel of variable moisture can be fed to the arrangement for burning. Another advantage is that the boiler is designed to use dry fuel, due to which the burning procedure is easy to implement technically and the boiler can be provided with an advantageous structure. It is then possible to use, for instance, several different alternative boiler grate solutions, high temperature can be achieved for the combustion chamber, due to which a great part of the heat energy can be recovered as radiation heat, little masonry is needed in the boiler, the fuel can be burnt accurately causing minor outlets, and further, condensation and corrosion problems can be avoided. In addition, the temperature of the combustion gases can be rather high, due to which the convection part of the boiler can be dimensioned to be small and the aging of the boiler is not significant. Moreover, when dry fuel is used, the heat energy of the combustion gases can be recovered through the combustion air back to the system to be utilized. The efficiency of the arrangement is also rather high irrespective of the moisture values of the fuel. Further, the arrangement can be built in such a way that its total price will be low. Likewise, the rather efficient arrangements can be implemented in such a manner that they can be positioned in movable containers, for instance.

BRIEF DESCRIPTION OF THE DRAWING

The invention will be described in more detail in the attached FIGURE showing an arrangement according to the invention schematically.

DESCRIPTION OF THE INVENTION

The FIGURE shows a boiler 1 comprising a combustion chamber 1*a* and a convection part 1*b* in a manner fully known per se. Further, the figure shows a feeding apparatus 2 of fuel 18 schematically. The fuel 18 can be fed into the boiler 1 e.g. by a screw conveyor or by using so-called stoker burning, for instance, or some other solution fully known per se. Since the feeding apparatus 2 of fuel 18 is fully known per se, it is not discussed further in this connection. Combustion gases are led out of the boiler 1 through a combustion gas duct 3. The combustion gases are conducted according to arrows A through a heat exchanger 4. The heat exchanger 4 heats the air flowing in an air duct 5. The air flows in the air duct 5 according to arrows B. The air heated by the heat exchanger 4 is conducted through a drying air duct 6 to a drying apparatus 7 to dry moist fuel 18. The heat exchanger 4 can either be a separate heat exchanger or an integral part of the boiler 1.

The drying apparatus 7 comprises an air permeable wire 8 forming an endless loop and arranged to go around rolls 9*a* and 9*b*. A chamber 10 is arranged in the middle of the loop formed by the wire 8. The heated air is conducted through the drying air duct 6 into the chamber 10. The heated air is blown out of the chamber 10 through the upper, permeable support part of the wire 8, whereby the air also flows through the fuel 18 above the wire 8 according to arrows C and D. The fuel 18 is fed on the wire 8 through a feed channel 11, for instance, The fuel 18 may consist e.g. of dry or unseasoned chips, bark, sawdust, grain screenings, waste from carpentry industry, sod peat or some other suitable plant-based disintegrated fuel. The first end of the chamber 10 is preferably sealed against the first roll 9*a* and the second end against the wire 8. By flowing through the fuel 18, the heated air extracts moisture from it. The temperature of the drying air and the speed of the wire 8 are preferably dimensioned in such a way that the air flowing out through the fuel 18 is substantially saturated with water vapor. The rolls 9*a* and 9*b* going around, i.e. the movement of the wire 8, may either be continuous or intermittent, and controlled by a step motor, for instance. However, the most essential thing is that the temperature and the outlet velocity of the drying air as well as the movement and surface area of the wire 8 are dimensioned in such a way that the fuel 18 can be dried sufficiently dry.

In the case according to the attached FIGURE, moist fuel 18 is fed to the drying apparatus of the arrangement according to the invention, whereby all the air heated by the heat exchanger 4 is directed by means of a damper 12 of the drying air duct 6 and a damper 14 of a combustion air duct 13 to dry the fuel 18. Thus, drying air duct 6 and combustion air duct 13 received the heated air flowing in air duct 5. Combustion air is then led from a secondary air duct 15 through the combustion air duct 13 into the boiler. The attached figure shows the procedure of leading combustion air in a simplified manner, but naturally, it is possible to lead both primary and secondary combustion air into the boiler in a manner fully known per se. When the fuel 18 is not so wet that all the air heated by the heat exchanger 4 has to be led to dry the fuel 18, the multipositional damper 12 of the drying air duct 6 is closed partly thus, drying air duct 6 and combustion air duct 13 received the heated air flowing in air duct 5, and the multipositional damper 14 of the combustion air duct 13 is opened partly, thus, drying air duct 6 and combustion air duct 13 received the heated air flowing in air duct 5, whereby part of the heated air is conducted to serve as combustion air of the boiler. Further, when the fuel 18 fed to the arrangement is so dry that no drying at all is needed, the damper 12 of the drying air duct 6 is closed entirely and the damper 14 of the combustion air duct 13 is opened in such a way that all the air heated by the heat exchanger 4 is conducted to serve as combustion air. For the sake of clarity, the attached figure does not show fans required for moving air in the ducts.

The dampers 12 and 14 can be controlled by a control device 17. Information on the temperature of the combustion chamber 1*a* detected by a sensor 16 is given to the control device 17. When rather moist fuel 18 changes into drier fuel, the fuel going into the combustion chamber 1*a* after the drying apparatus 7 is dryer than before and the temperature of the combustion chamber 1*a* rises. The sensor 16 detects this temperature rise, due to which the control device 17 controls the dampers 12 and 14 in such a way that a greater part than before of the air heated by the heat exchanger 4 will serve as combustion air. When the temperature rises further, the control device 17 closes the damper 12 of the drying air duct 6 entirely and all the combustion air can be preheated. When the fuel changes into a moister fuel than before, the temperature of the combustion chamber la begins to fall and the control device 17 controls the air heated by the air exchanger 4 by means of the dampers 12 and 14 to dry the fuel 18 more than before. The dampers 12 and 14 can also be controlled on the basis of the outlet temperature or outlet moisture of the drying air, for instance, or on the basis of some other suitable basic data.

The boiler 1 of the arrangement according to the invention is designed for dry fuel, which in this connection signifies that special solutions necessary for burning moist fuel need not be taken into consideration in the structure of the boiler 1. For instance, prices of solutions to feed and grate problems of the fuel may be low, without the reliability of operation suffering, however. The starting point of the designing may, for instance, be that such fuel is dry fuel which always has a moisture of 35% or less. In the structure of the boiler, attention can then easily be paid to the fact that, for instance, fuel of a moisture of 10% or even quite tinder-dry fuel is fed to the arrangement. Calculations have proved that the moisture of the fuel to be fed to the arrangement may be for instance 60%, and nevertheless, the efficiency of the arrangement can be kept rather good. When drier fuels than this are used, the efficiency is better still, of course. When drier fuel is used, the temperature of the combustion chamber 1*a* rises, which intensifies the heat transfer to the boiler.

The combustion gases can be removed from the boiler 1 in a rather hot state, (e.g., at about 300 to 400° C. degrees, and more preferably 350 to 400° C. degrees, for instance). Then the convection part 1*b* of the boiler can be made small, and simultaneously, the problems with the arrangement getting dirty are decreased. The temperature of the combustion gases can be dropped by the heat exchanger 4 to about 100° C. degrees, for instance. Then the air in the air duct 5 can be heated by the heat exchanger 4 rather well.

The FIGURE and the related description are only intended to illustrate the idea of the invention. As to the details, the invention may vary in the scope of the claims. So, prior art techniques can be used for storing fuel and feeding it to the drying apparatus, for instance.

What is claimed:

1. A method of burning plant-based fuel, in which method the plant-based fuel is burned in a boiler designed for burning dry fuel, with the plant-based fuel being used having a moisture value which can vary in a range from dry to wet, comprising:

heating air with heat energy from combustion gases of the boiler to provide a source of heated air;

dimensioning heat and flow amounts of the heated air in such a way that heated air, with derived heat energy from the combustion gases, is directed to the fuel in an amount sufficient for drying the fuel in any condition presented amongst the range between dry and wet, and that flow of the heated air directed to the fuel is controlled to provide sufficient drying of the fuel before use of the fuel in the boiler and such that the heated air not needed for drying the fuel is conducted into the boiler to serve as combustion air.

2. The method according to claim 1, wherein the plant based fuel is a fuel selected from a group consisting of:

dry or unseasoned chips, bark, sawdust, grain screenings, carpentry industry waste, or sod peat.

3. The method according to claim 1 in that wet fuel is dried while being supported on an air permeable support by directing the heated air needed for drying the fuel through the air permeable support and in contact with the fuel supported on said permeable support.

4. The method according to claim 1 wherein heated air directed to said fuel passes away from said fuel in a saturated water vapor state.

5. Method according to claim 1 characterized in that the combustion gases of the boiler have a temperature of 300 to 400° C. when removed from the boiler.

6. Method according to claim 1 characterized in that a temperature of a combustion chamber of the boiler is measured and, on the basis of the measurement, an adjustment in a relative quantity of the heated air to be directed to dry the fuel is made with respect to the quantity of air serving as combustion air of the boiler.

7. The method according to claim 1 wherein the heated air needed for drying the fuel is sufficient to dry a fuel having a moisture content of 60%.

8. The method according to claim 1 further comprising adjusting a relative percentage of heated air needed for drying to conform with a moisture content of the fuel to be dried which moisture content is up to 60%.

9. The method according to claim 1 further comprising passing wet fuel through a drying apparatus with a permeable support through which the needed heated air for drying passes, and wherein the heated air that has passed through the wet fuel and has an increased moisture content is directed away from said boiler so as not to be received in said boiler.

10. The method according to claim 1 wherein the plant-based fuel being dried is a crushed plant-based fuel.

11. A method of burning plant-based fuel, in which method the plant-based fuel is burned in a boiler designed for burning dry fuel, with the plant-based fuel being used having a moisture value which can vary in a range from dry to wet, comprising:

heating air with heat energy from combustion gases of the boiler to provide a source of heated air;

dimensioning heat and flow amounts of the heated air in such a way that heated air, with derived heat energy from the combustion gases, is directed to the fuel in an amount sufficient for drying the fuel in any condition presented amongst the range between dry and wet, and that flow of the heated air directed to the fuel is controlled to provide sufficient drying of the fuel before use of the fuel in the boiler and such that the heated air not needed for drying the fuel is conducted into the boiler to serve as combustion air, and wherein a remaining portion of the heated air that is not needed for drying the fuel is combined with ambient air from a different source line before being introduced into the combustion chamber.

12. A method of burning plant-based fuel, in which method the plant-based fuel is burned in a boiler designed for burning dry fuel, with the plant-based fuel being used having a moisture value which can vary in a range from dry to wet, comprising:

heating air with heat energy from combustion gases of the boiler to provide a source of heated air;

dimensioning heat and flow amounts of the heated air in such a way that heated air, with derived heat energy from the combustion gases, is directed to the fuel in an amount sufficient for drying the fuel in any condition presented amongst the range between dry and wet, and that flow of the heated air directed to the fuel is controlled to provide sufficient drying of the fuel before use of the fuel in the boiler and such that the heated air not needed for drying the fuel is conducted into the boiler to serve as combustion air, and in that wet fuel is dried while being supported on an air permeable support by directing the heated air needed for drying the fuel through the air permeable support and in contact with the fuel supported on said permeable support, and wherein a flow rate and temperature of the heated air needed for drying the fuel are set at a level which results in air flowing out past through the fuel supported on the permeable support in a saturated water vapor state, and said permeable support being a movable permeable support, and said method further comprising controlling movement of the permeable support to provide a desired degree of drying prior to entry of the fuel into the boiler.

13. A method of burning plant-based fuel, in which method the plant-based fuel is burned in a boiler designed for burning dry fuel, with the plant-based fuel being used having a moisture value which can vary in a range from dry to wet, comprising:

heating air with heat energy from combustion gases of the boiler to provide a source of heated air;

dimensioning heat and flow amounts of the heated air in such a way that heated air, with derived heat energy from the combustion gases, is directed to the fuel in an amount sufficient for drying the fuel in any condition presented amongst the range between dry and wet, and that flow of the heated air directed to the fuel is controlled to provide sufficient drying of the fuel before use of the fuel in the boiler and such that the heated air not needed for drying the fuel is conducted into the boiler to serve as combustion air, and wherein air traveling in a single main conduit is subjected, by way of a heat exchanger, to combustion gases exiting said boiler to provide said heated air, and the heated air is directed to a first downstream line through which the heated air needed for drying a wet state of fuel passes and a second downstream line through which any remaining portion of the heated air not directed to the fuel travels, and the method including controlling a first damper in said first downstream line so as to vary the amount of heated air traveling in said first downstream line between a closed damper state when the fuel being used is sufficiently dry from start, and a second, full open state when the fuel being used has a high end range wetness level.

14. The method as recited in claim 13 wherein the method includes controlling a position of a second damper in said second downstream line between an open state and a closed state with the closed state providing for total heated air passage through said first downstream line feeding to the fuel.

15. A method of burning plant-based fuel, in which method the plant-based fuel is burned in a boiler designed for burning dry fuel, with the plant-based fuel being used having a moisture value which can vary in a range from dry to wet, comprising:

heating air with heat energy from combustion gases of the boiler to provide a source of heated air;

dimensioning heat and flow amounts of the heated air in such a way that heated air, with derived heat energy from the combustion gases, is directed to the fuel in an amount sufficient for drying the fuel in any condition presented amongst the range between dry and wet, and that flow of the heated air directed to the fuel is controlled to provide sufficient drying of the fuel before use of the fuel in the boiler and such that the heated air not needed for drying the fuel is conducted into the boiler to serve as combustion air, and further comprising adjusting a damper system to provide a first percentage of all of the heated air to said fuel for drying and a second percentage of all of the heated air to a combustion chamber of said boiler, with said first and second percentages representing a full amount of the heated air deriving heat energy from the combustion gases.

16. A burning apparatus for burning plant-based fuel, comprising:

a boiler designed as a dry fuel boiler;

a fuel feeding apparatus which is positioned for feeding fuel to a combustion chamber of the boiler, which plant based fuel can have a moisture content ranging from dry to wet;

a drying apparatus for drying fuel to be fed to said boiler;

a heat exchanger and an air duct with the heat exchanger being arranged to heat air flowing in the air duct with heat energy derived from combustion gases of the boiler fed to the heat exchanger by a combustion gas conduit, said heat exchanger and air duct being dimensioned and arranged such that air flowing in said air duct and past the heat exchanger is sufficient for drying the fuel being fed to said boiler for all moisture conditions of the fuel being fed;

a heated air conduit system for conducting heated air heated by said heat exchanger to the drying apparatus and to said combustion chamber as a source of combustion air; and means for controlling a relative flow of heated air in said conduit system for providing a sufficient quantity of heated air to the fuel, when wet, to achieve a drying of the fuel and directing heated air not needed for drying the fuel to the boiler to serve as combustion air.

17. The apparatus as recited in claim 16 wherein said drying apparatus comprises a moveable permeable support for feeding fuel while supported on said permeable support to said boiler, and means for directing heated air from said air duct through the permeable support for drying the fuel.

18. The apparatus according to claim 16 further comprising a damper system for controlling the flow of heated air heated by said heat exchanger and directed through said heated air conduit system, a sensor for measuring combustion chamber temperature, and a control device for altering the damper system based on a measurement of the sensor.

19. The apparatus as recited in claim 16 wherein the fuel is a crushed fuel, and said drying apparatus includes an air permeable wire support which supports the crushed fuel in an above state.

20. The apparatus as recited in claim 16 wherein said means for controlling the relative flow of heated air in said conduit system includes minimizing flow to said dryer when the fuel is in a dry state and maximizing flow to said dryer when the fuel is in a high wet state of up to 60% moisture content so that heated air passing through the wet fuel leaves at a full water saturation state.

21. A burning apparatus for burning plant-based fuel, comprising:

a boiler designed as a dry fuel boiler;

a fuel feeding apparatus which is positioned for feeding fuel to a combustion chamber of the boiler, which plant based fuel can have a moisture content ranging from dry to wet;

a drying apparatus for drying fuel to be fed to said boiler;

a heat exchanger and an air duct with the heat exchanger being arranged to heat air flowing in the air duct with heat energy derived from combustion gases of the boiler fed to the heat exchanger by a combustion gas conduit, said heat exchanger and air duct being dimensioned and arranged such that air flowing in said air duct and past the heat exchanger is sufficient for drying the fuel being fed to said boiler for all moisture conditions of the fuel being fed;

a heated air conduit system for conducting heated air heated by said heat exchanger to the drying apparatus and to said combustion chamber as a source of combustion air and said conduit system being in heated air communication with said air duct; and, means for controlling a relative flow of heated air in said conduit system for providing a sufficient quantity of heated air to the fuel, when wet, to achieve a drying of the fuel and directing heated air not needed for drying the fuel to the boiler to serve as combustion air; and wherein said heated air conduit system includes a combustion air branch line branching off said air duct and to said boiler and an extension of said air duct to said drying apparatus.

22. The apparatus as recited in claim 21 further comprising a first damper positioned within the extension of said air duct and being a multi-positionable damper with positions including a closed position for situations when the fuel is not in need of drying and a full open state for handling fuel having a maximum system wetness level.

23. The apparatus as recited in claim 22 further comprising a second combustion air feed line that opens into said combustion air branch line and a second damper positioned in said combustion air branch line upstream of an inlet location of said second combustion air feed line into said combustion air branch line and said second damper being multi-positionable including a closed position for providing all of the heated air to the extension of said air duct for drying fuel having a maximum wetness level, and an open state for directing all heated air of said air duct to said boiler, when said first damper is closed.

* * * * *